US008754018B2

(12) United States Patent
Scherer et al.

(10) Patent No.: US 8,754,018 B2
(45) Date of Patent: Jun. 17, 2014

(54) USE OF POLYALKYL (METH)ACRYLATES IN LUBRICATING OIL COMPOSITIONS

(75) Inventors: Markus Scherer, Cologne (DE); Klaus Hedrich, Fischbachtal (DE); Michael Alibert, Darmstadt (DE); Michael Mueller, Bensheim (DE); Roland Schweder, Darmstadt (DE)

(73) Assignee: EVONIK ROHMAX ADDITIVES GmbH, Darmstadt (DE)

( * ) Notice: Subject to any disclaimer, the term of this patent is extended or adjusted under 35 U.S.C. 154(b) by 352 days.

(21) Appl. No.: 11/547,612

(22) PCT Filed: Feb. 24, 2005

(86) PCT No.: PCT/EP2005/001907

§ 371 (c)(1),
(2), (4) Date: Oct. 4, 2006

(87) PCT Pub. No.: WO2005/108531

PCT Pub. Date: Nov. 17, 2005

(65) Prior Publication Data

US 2007/0219101 A1 Sep. 20, 2007

(30) Foreign Application Priority Data

Apr. 30, 2004 (DE) ..... 10 2004 021 778

(51) Int. Cl.
*C10M 145/14* (2006.01)

(52) U.S. Cl.
USPC ..... 508/469; 508/459

(58) Field of Classification Search
USPC ..... 508/469
See application file for complete search history.

(56) References Cited

U.S. PATENT DOCUMENTS

| | | | | |
|---|---|---|---|---|
| 3,304,260 | A | 2/1967 | Fields et al. | |
| 4,618,439 | A * | 10/1986 | Brandi et al. | 508/258 |
| 5,108,635 | A * | 4/1992 | Gabillet et al. | 508/221 |
| 6,096,173 | A | 8/2000 | Von Hippel et al. | |
| 6,124,249 | A | 9/2000 | Seebauer et al. | |
| 6,391,996 | B1 | 5/2002 | Scherer et al. | |
| 6,403,745 | B1 | 6/2002 | Scherer et al. | |
| 6,458,750 | B1 | 10/2002 | Dardin et al. | |
| 6,458,789 | B1 * | 10/2002 | Forood et al. | 514/235.5 |
| 7,235,298 | B2 | 6/2007 | Katusic et al. | |
| 7,288,501 | B2 | 10/2007 | Auer et al. | |
| 7,374,743 | B2 | 5/2008 | Katusic et al. | |
| 7,525,788 | B2 | 4/2009 | Hoerpel et al. | |

(Continued)

FOREIGN PATENT DOCUMENTS

| | | |
|---|---|---|
| CA | 2 396 671 A1 | 6/2001 |
| DE | 100 15 541 | 6/2001 |

(Continued)

OTHER PUBLICATIONS

U.S. Appl. No. 11/587,988, filed Oct. 30, 2006, Fischer, et al.

(Continued)

*Primary Examiner* — Taiwo Oladapo
(74) *Attorney, Agent, or Firm* — Oblon, Spivak, McClelland, Maier & Neustadt, L.L.P.

(57) ABSTRACT

The invention relates to the use of polyalkyl ester for reducing the temperature in a lubricating oil composition. The polyalkyl ester has a specific viscosity $\eta_{sp/c}$ of between 5 and 30 ml/g, measured in chloroform at 25° C.

16 Claims, 1 Drawing Sheet

(56) References Cited

U.S. PATENT DOCUMENTS

| | | | | |
|---|---|---|---|---|
| 2001/0036437 | A1 | 11/2001 | Gutsch et al. | |
| 2001/0055639 | A1 | 12/2001 | Moritz et al. | |
| 2002/0049144 | A1* | 4/2002 | Clement et al. | 508/421 |
| 2003/0206854 | A1 | 11/2003 | Gutsch et al. | |
| 2004/0092409 | A1* | 5/2004 | Liesen | 508/469 |
| 2005/0148749 | A1 | 7/2005 | Scherer et al. | |
| 2005/0221192 | A1 | 10/2005 | Hennige et al. | |
| 2005/0239937 | A1 | 10/2005 | Scherer et al. | |
| 2005/0245406 | A1 | 11/2005 | Scherer et al. | |
| 2005/0261143 | A1 | 11/2005 | Scherer et al. | |
| 2005/0267239 | A1 | 12/2005 | Scherer | |
| 2006/0189490 | A1 | 8/2006 | Dardin et al. | |
| 2006/0240999 | A1 | 10/2006 | Placek et al. | |
| 2007/0175362 | A1 | 8/2007 | Gutsch et al. | |
| 2007/0197410 | A1 | 8/2007 | Placek et al. | |
| 2007/0254178 | A1 | 11/2007 | Nun | |
| 2008/0020190 | A1 | 1/2008 | Nun et al. | |
| 2008/0032197 | A1 | 2/2008 | Horpel et al. | |
| 2008/0084686 | A1 | 4/2008 | Gutsch et al. | |
| 2008/0138700 | A1 | 6/2008 | Horpel et al. | |
| 2008/0280050 | A1 | 11/2008 | Nun et al. | |
| 2008/0283171 | A1 | 11/2008 | Nun et al. | |
| 2008/0302422 | A1 | 12/2008 | Neveu et al. | |
| 2008/0305702 | A1 | 12/2008 | Nun et al. | |
| 2009/0078485 | A1 | 3/2009 | Gutsch et al. | |
| 2009/0182145 | A1 | 7/2009 | Boehmke et al. | |
| 2010/0000079 | A1 | 1/2010 | Horpel et al. | |
| 2010/0003401 | A1 | 1/2010 | Horpel et al. | |

FOREIGN PATENT DOCUMENTS

| | | |
|---|---|---|
| EP | 0635560 | 1/1995 |
| EP | 0635561 | 1/1995 |
| EP | 0823472 | 2/1998 |
| EP | 0 979 834 | 2/2000 |
| JP | 07-062372 | 3/1995 |
| JP | 07-070247 | 3/1995 |
| JP | 9-048988 | 2/1997 |
| JP | 10-077494 | 3/1998 |
| JP | 11-279233 | 10/1999 |
| JP | 2003-515632 | 5/2003 |
| JP | 2003-515633 | 5/2003 |
| WO | 2004 087850 | 10/2004 |

OTHER PUBLICATIONS

Dardin et al., "Influence of Polyalkylmethacrylate Viscosity Index Improvers on the Efficiency of Lubricants", SAE Paper, pp. 1-9, 2003.

U.S. Appl. No. 10/592,363, filed Sep. 11, 2006, Scherer, et al.
U.S. Appl. No. 10/593,082, filed Sep. 15, 2006, Scherer, et al.
U.S. Appl. No. 11/572,181, filed Jan. 16, 2007, Scherer, et al.
U.S. Appl. No. 11/572,330, filed Jan. 19, 2007, Acker, et al.
U.S. Appl. No. 11/995,949, Jan. 17, 2008, Stoehr, et al.
U.S. Appl. No. 11/815,624, filed Aug. 6, 2007, Mueller, et al.
U.S. Appl. No. 11/909,171, filed Sep. 20, 2007, Stoehr, et al.
U.S. Appl. No. 12/279,732, filed Aug. 18, 2008, Stoehr, et al.
U.S. Appl. No. 61/105,065, filed Oct. 14, 2008, Placek, et al.
U.S. Appl. No. 12/347,608, Dec. 31, 2008, Michael, et al.
U.S. Appl. No. 12/668,209, filed Jan. 8, 2010, Stoehr, et al.
U.S. Appl. No. 61/186,744, filed Jun. 12, 2009, Radano, et al.
U.S. Appl. No. 12/672,231, filed Feb. 4, 2010, Stoehr, et al.
U.S. Appl. No. 60/021,600, filed Jul. 11, 1996, Riemenschneider, et al.
U.S. Appl. No. 08/842,775, filed Apr. 17, 1997, Riemenschneider, et al.
U.S. Appl. No. 09/441,439, filed Nov. 17, 1999, Barthold, et al.
U.S. Appl. No. 60/194,367, Apr. 4, 2002, Michael, et al.
U.S. Appl. No. 12/746,683, filed Jun. 7, 2010, Hedrich, et al.
Office Action issued Mar. 8, 2012, in Canadian Patent Application No. 2,560,125.
"Viskositat", Römpp-Lexikon Chemie, Georg Thieme Verlag, Stuttgart, ISBN 3-13-735010-3, Band 6, 10. Aufl., S. 4875/4876, 1999, 3 pages (English translation only).
U.S. Appl. No. 13/255,218, filed Sep. 7, 2011, Eisenberg, et al.
U.S. Appl. No. 13/213,547, filed Aug. 19, 2011, Mueller, et al.
U.S. Appl. No. 13/202,744, filed Aug. 22, 2011, Eisenberg, et al.
U.S. Appl. No. 13/318,492, filed Nov. 2, 2011, Radano, et al.
U.S. Appl. No. 61/421,867, filed Dec. 10, 2010, Radano, et al.
U.S. Appl. No. 61/408,274, Oct. 29, 2010, Neveu, et al.
U.S. Appl. No. 61/421,870, filed Dec. 10, 2010, Radano.
Office Action issued Dec. 5, 2012 in Canadian Patent Application No. 2,560,125.
Office Action issued Jan. 23, 2012 in Europe Application No. 05707597.0.
Office Action issued Mar. 9, 2011 in Japanese Application No. 2007-509895 (English translation).
Canadian Office Action issued Aug. 5, 2011, in Patent Application No. 2,560,125.
M.P. Stevens, "Polymer Chemistry, An Introduction," Oxford University Press, Third Edition, (1999).
Viscosity, Indian Academy of Sciences, Chapter 6, pp. 77-88, printed from www.ias.ac.in/initiat/sci_ed/resources/chemistry/Viscosity.pdf.

* cited by examiner

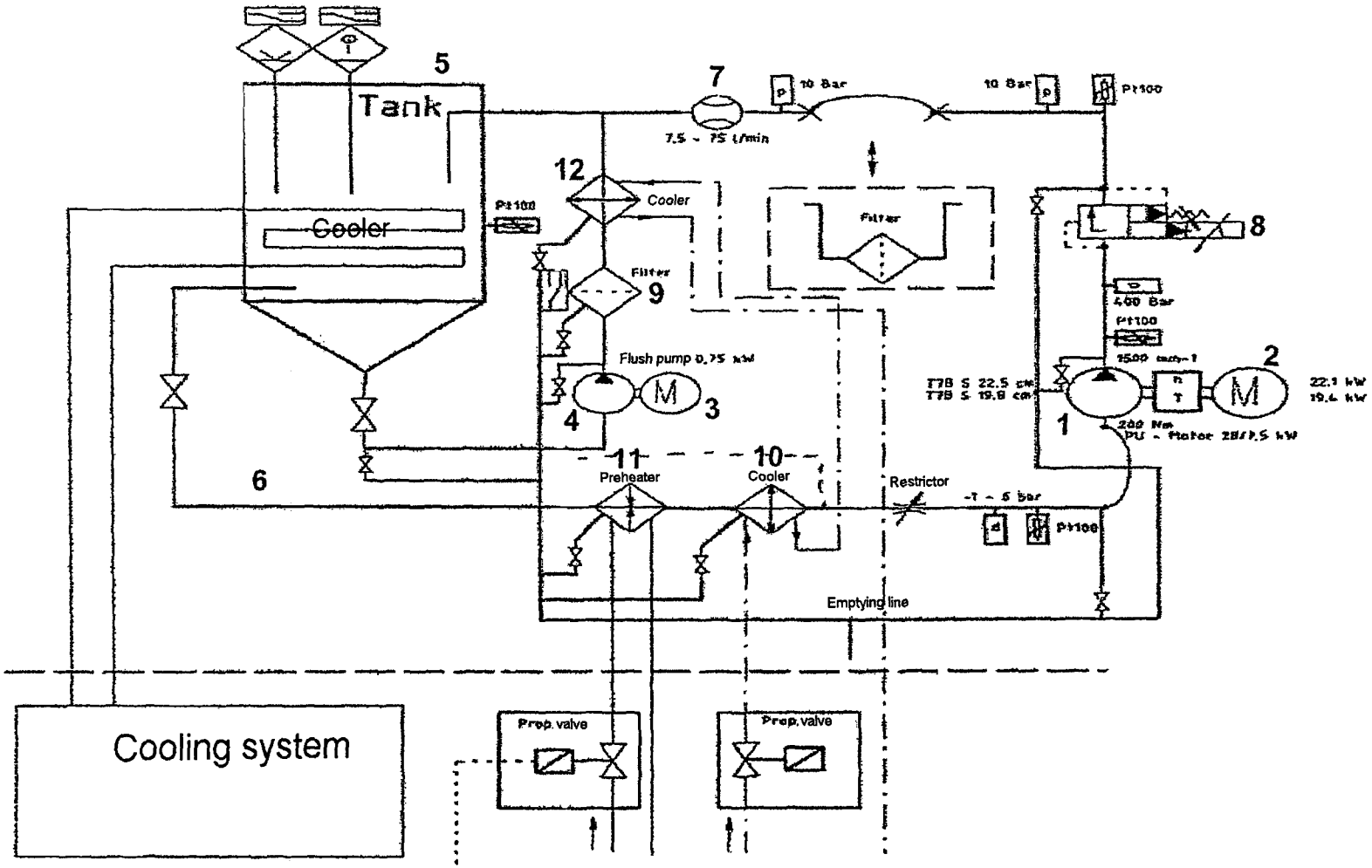
Tank
Cooler
Cooling system
Filter
Cooler
Filter
Flush pump 0,75 kW
Preheater
Cooler
Restrictor
Emptying line
Prep. valve
Prep. valve
10 Bar
10 Bar
7,5 - 75 l/min
Pt100
Pt100
Pt100
Pt100
4,00 Bar
-1 - 5 bar
1
2
3
4
5
6
7
8
9
10
11
12

USE OF POLYALKYL (METH)ACRYLATES IN LUBRICATING OIL COMPOSITIONS

RELATED APPLICATION

This application is a national stage entry of PCT/EP05/01907, filed on Feb. 24, 2005, which claims priority from German Patent Application No. 10 2004 021 778.5, filed Apr. 30, 2004, which is incorporated by reference in its entirety.

The present invention relates to the use of polyalkyl (meth) acrylates in lubricant oil compositions.

The overheating of mobile hydraulic plants under difficult operating conditions is a known problem. Friction on individual components of the hydraulic system, volume flow rates with high pressure drop and the flow resistances in the pipe system lead to a temperature increase in the hydraulic fluid.

Air-oil heat exchangers, convection and radiation of heat from the system components simultaneously counteract a temperature increase. The design of individual system components, environmental conditions, mode of operation and duration have an effect on the resulting operating temperature of the hydraulic fluid employed. In the design process, according to the equipment type, intermittent operation with corresponding shutdown times and the resulting fluid cooling are assumed. Assumptions likewise have to be made in the estimation of the ambient temperature.

When the operation deviates from these design assumptions (high proportion of time in operation at maximum performance and higher ambient temperature), the result is a constantly rising fluid temperature. The rise in the fluid temperature reduces the viscosity of the hydraulic fluid and the function and lifetime of individual system components, especially of the hydraulic pumps and motors.

To protect the system components, an acoustic or optical warning is first triggered on attainment of a critical fluid temperature. In the event of a further temperature rise, the system is shut down. For the completion of construction operations or comparable working procedures subject to deadlines, such events are difficult to predict and hence extremely inconvenient.

Simple construction solutions such as enlarged fluid reservoir vessels, more effective cooling units and larger hydraulic pumps working at lower pressure are, however, afflicted with disadvantages, since they are associated with equipment dimensions, system costs and hence higher equipment prices, which have not been able to become established on the market. On the contrary, the historic consideration of dimensions, working pressures and especially size of the reservoir vessels for hydraulic fluids shows that unit constructions develop toward higher pressures, distinctly smaller reservoir vessels and inadequate cooling performance. In addition, acoustic encapsulations of motor and hydraulic pump restrict the natural release of heat to the environment.

Equipment operators and component suppliers frequently complain of this problem. Typical equipment includes, for example, excavators, wheel loaders, tractors and special equipment for agriculture, forestry and strip mining. In view of the prior art, it was thus an object of the present invention to specify a simple solution for the above-discussed problem of overheating of hydraulic systems. In particular, the solution shall be achieved without a perceptible impairment of performance. It was a further object of the present invention to provide a solution which can be used even in hydraulic systems which are already in operation.

A further object can be discerned in the provision of a solution which can be implemented particularly inexpensively. In this context, environmental pollution in particular shall be avoided.

These objects and further objects which are not specified explicitly but which can be derived or discerned directly from the connections discussed by way of introduction herein are achieved by the use of polyalkyl(meth)acrylates having all features of claim 1. Appropriate modifications of the inventive use are protected in the subclaims dependent upon claim 1. With regard to particular lubricant oil compositions, claim 14 provides a solution of the underlying object.

The use of polyalkyl(meth)acrylates for reducing the temperature in a lubricant oil composition succeeds, in a manner which was not directly foreseeable, in providing hydraulic fluids with which the problem outlined above can be reduced in a simple manner.

At the same time, the inventive use can achieve a series of further advantages. These include:

- The inventive use can be used in already produced hydraulic systems.
- The inventive use prevents overheating of hydraulic systems.
- The inventive use allows a high performance of the hydraulic systems without the temperature rising into a critical range. Hence, the present use contributes to a rise in performance of these systems and to a lowering of the temperature of the hydraulic fluid.
- The use of the present invention can be carried out in a particularly easy and simple manner.
- The present inventive use exhibits high environmental compatibility.

According to the invention, polyalkyl esters are used in a lubricant oil composition.

In the context of the present invention, polyalkyl esters are polymers which are derived from olefinic esters. These polymers are known in the technical field and commercially available. Particularly preferred polymers of this class may be obtained by polymerization of monomer compositions which may especially have (meth)acrylates, maleates and/or fumarates which may have different alcohol radicals.

The expression (meth)acrylates encompasses meth-acrylates and acrylates, and also mixtures of the two. These monomers are well known. The alkyl radical may be linear, cyclic or branched.

Preferred mixtures from which preferred polyalkyl esters are obtainable may contain from 0 to 50% by weight, in particular from 2 to 40% by weight and more preferably from 10 to 30% by weight, based on the weight of the monomer compositions for preparing the polyalkyl esters, of one or more ethylenically unsaturated ester compounds of the formula (I)

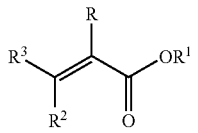

(I)

in which R is hydrogen or methyl, $R^1$ is a linear or branched alkyl radical having from 1 to 5 carbon atoms, $R^2$ and $R^3$ are each independently hydrogen or a group of the formula —COOR' in which $R^1$ is hydrogen or an alkyl group having from 1 to 5 carbon atoms.

Examples of component a) include (meth)acrylates, fumarates and maleates which derive from saturated alcohols, such as methyl(meth)acrylate, ethyl (meth)acrylate, n-propyl (meth)acrylate, isopropyl (meth)acrylate, n-butyl(meth)acrylate, tert-butyl (meth)acrylate and pentyl(meth)acrylate;

cycloalkyl(meth)acrylates such as cyclopentyl (meth)acrylate;

(meth)acrylates which derive from unsaturated alcohols, such as 2-propynyl(meth)acrylate, allyl(meth)acrylate and vinyl(meth)acrylate.

As a further constituent, the compositions to be polymerized for the preparation of preferred polyalkyl esters may contain from 50 to 100% by weight, in particular from 60 to 98% by weight and more preferably from 70 to 90% by weight, based on the weight of the monomer compositions for preparing the polyalkyl esters, of one or more ethylenically unsaturated ester compounds of the formula (II)

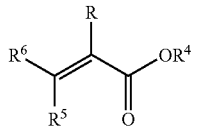

(II)

in which R is hydrogen or methyl, $R^4$ is a linear or branched alkyl radical having from 6 to 30 carbon atoms, $R^5$ and $R^6$ are each independently hydrogen or a group of the formula —COOR" in which R" is hydrogen or an alkyl group having from 6 to 30 carbon atoms.

These include (meth)acrylates, fumarates and maleates which derive from saturated alcohols, such as hexyl(meth) acrylate, 2-ethylhexyl (meth)acrylate, heptyl (meth)acrylate, 2-tert-butylheptyl (meth)acrylate, octyl (meth)-acrylate, 3-isopropylheptyl (meth)acrylate, nonyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)-acrylate, tetradecyl (meth)acrylate, pentadecyl (meth) acrylate, hexadecyl (meth)acrylate, 2-methyl-hexadecyl (meth)acrylate, heptadecyl (meth)acrylate, 5-isopropylheptadecyl (meth)acrylate, 4-tert-butyl-octadecyl (meth)acrylate, 5-ethyloctadecyl (meth)-acrylate, 3-isopropyloctadecyl (meth)acrylate, octadecyl (meth)acrylate, nonadecyl (meth) acrylate, eicosyl (meth)acrylate, cetyleicosyl (meth)acrylate, stearyleicosyl (meth)acrylate, docosyl (meth)acrylate and/or eicosyltetratriacontyl (meth)acrylate;

cycloalkyl (meth)acrylates such as 2,4,5-tri-t-butyl-3-vinylcyclohexyl (meth)acrylate, 2,3,4,5-tetra-t-butyl-cyclohexyl (meth)acrylate;

(meth)acrylates which derive from unsaturated alcohols, for example oleyl(meth)acrylate;

cycloalkyl(meth)acrylates such as 3-vinylcyclohexyl (meth)acrylate, cyclohexyl (meth)acrylate, bornyl (meth) acrylate; and also the corresponding fumarates and maleates.

The ester compounds with long-chain alcohol radical, especially the compounds in component (b), can be obtained, for example, by reacting (meth)acrylates, fumarates, maleates and/or the corresponding acids with long-chain fatty alcohols to form generally a mixture of esters, for example (meth)acrylates with different long-chain alcohol radicals. These fatty alcohols include Oxo Alcohol® 7911 and Oxo Alcohol® 7900 and Oxo Alcohol® 1100 from Monsanto; Alphanol® 79 from ICI; Nafol® 1620, Alfol® 610 and Alfol® 810 from Sasol; Epal® 610 and Epal® 810 from Ethyl Corporation; Linevol® 79, Linevol® 911 and Dobanol® 25L from Shell AG; Lial 125 from Sasol; Dehydad® and Lorol® types from Cognis.

In a particular aspect of the present invention, the mixture for preparing preferred polyalkyl esters has at least 60% by weight, preferably at least 70% by weight, based on the weight of the monomer compositions for preparing the polyalkyl esters, of monomers of the formula (II).

Among the ethylenically unsaturated ester compounds, particular preference is given to the (meth)acrylates over the maleates and the fumarates, i.e. $R^2$, $R^3$, $R^5$ and $R^6$ in the formulae (I) and (II) are, in particularly preferred embodiments, hydrogen. In general, preference is given to the methacrylates over the acrylates.

In a particular embodiment of the present invention, preferably at least 50% by weight, more preferably at least 70% by weight, of the $R^4$ radicals in the formula (II) are linear.

The ratio of branched to the linear side chains of the $R^4$ radicals in the formula (II) is preferably in the range from 0.0001 to 0.3, more preferably in the range from 0.001 to 0.1.

In a particular aspect of the present invention, it is possible to use a polyalkyl(meth)acrylate in which at least 60% by weight of the ethylenically unsaturated ester compounds of the formula (II) are alkyl (meth)acrylates, based on the total weight of the ethylenically unsaturated ester compounds of the formula (II).

In a particular aspect of the present invention, preference is given to using mixtures of long-chain alkyl(meth)acrylates in the component of the formula (II), the mixtures having at least one (meth)acrylate having from 6 to 15 carbon atoms in the alcohol radical and at least one (meth)acrylate having from 16 to 30 carbon atoms in the alcohol radical. The proportion of the (meth)acrylates having from 6 to 15 carbon atoms in the alcohol radical is preferably in the range from 20 to 95% by weight based on the weight of the monomer composition for preparing the polyalkyl esters. The proportion of the (meth) acrylates having from 16 to 30 carbon atoms in the alcohol radical is preferably in the range from 0.5 to 60% by weight, based on the weight of the monomer composition for preparing the polyalkyl esters.

In a further aspect of the present invention, the proportion of olefinically unsaturated esters having from 8 to 14 carbon atoms is preferably greater than or equal to the proportion of olefinically unsaturated esters having from 16 to 18 carbon atoms.

Preferred mixtures for preparing preferred polyalkyl esters may additionally especially comprise ethylenically unsaturated monomers which can be copolymerized with the ethylenically unsaturated ester compounds of the formulae (I) and/or (II). The proportion of comonomers is preferably in the range from 0 to 50% by weight, in particular from 2 to 40% by weight and more preferably from 5 to 30% by weight, based on the weight of the monomer compositions for preparing the polyalkyl esters.

Particularly suitable comonomers for polymerization in the present invention correspond to the formula:

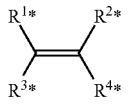

in which $R^{1*}$ and $R^{2*}$ are each independently selected from the group consisting of hydrogen, halogens, CN, linear or branched alkyl groups having from 1 to 20, preferably from 1 to 6 and more preferably from 1 to 4, carbon atoms which may be substituted by from 1 to (2n+1) halogen atoms, where n is the number of carbon atoms of the alkyl group (for example $CF_3$), α,β-unsaturated linear or branched alkenyl or alkynyl groups having from 2 to 10, preferably from 2 to 6 and more preferably from 2 to 4, carbon atoms which may be substituted by from 1 to (2n−1) halogen atoms, preferably chlorine, where n is the number of carbon atoms of the alkyl group, for example $CH_2{=}CCl{-}$, cyclo-alkyl groups having from 3 to 8 carbon atoms which may be substituted by from 1 to (2n−1) halogen atoms, preferably chlorine, where n is the number of carbon atoms of the cycloalkyl group; aryl groups having from 6 to 24 carbon atoms which may be substituted by from 1 to (2n−1) halogen atoms, preferably chlorine and/or alkyl groups having from 1 to 6 carbon atoms, where n is the number of carbon atoms of the aryl group; $C({=}Y^*)R^{5*}$, $C({=}Y^*)NR^{6*}R^{7*}$, $Y^*C({=}Y^*)R^{5*}$, $SOR^{5*}$, $SO_2R^{5*}$, $OSO_2R^{5*}$, $NR^{8*}SO_2R^{5*}$, $PR^{5*}_2$, $P({=}Y^*)R^{5*}_2$, $Y^*PR^{5*}_2$, $Y^*P({=}Y^*)R^{5*}_2$, $NR^{8*}_2$ which may be quaternized with an additional $R^{8*}$, aryl or heterocyclyl group, where Y* may be $NR^{8*}$, S or O, preferably O; $R^{5*}$ is an alkyl group having from 1 to 20 carbon atoms, an alkylthio having from 1 to 20 carbon atoms, $OR^{15}$. ($R^{15}$ is hydrogen or an alkali metal), alkoxy of from 1 to 20 carbon atoms, aryloxy or hetero-cyclyloxy; $R^{6*}$ and $R^{7*}$ are each independently hydrogen or an alkyl group having from 1 to 20 carbon atoms, or $R^{6*}$ and $R^{7*}$ together may form an alkylene group having from 2 to 7, preferably from 2 to 5, carbon atoms, in which case they form a 3- to 8-membered, preferably 3- to 6-membered, ring, and $R^{8*}$ is hydrogen, linear or branched alkyl or aryl groups having from 1 to 20 carbon atoms;

$R^{3*}$ and $R^{4*}$ are independently selected from the group consisting of hydrogen, halogen (preferably fluorine or chlorine), alkyl groups having 1 to 6 carbon atoms and $COOR^{9*}$ in which $R^{9*}$ is hydrogen, an alkali metal or an alkyl group having from 0.1 to 40 carbon atoms, or $R^{3*}$ and $R^{4*}$ together may form a group of the formula $(CH_2)$ n which may be substituted by from 1 to 2n' halogen atoms or $C_1$ to $C_4$ alkyl groups, or form the formula $C({=}O){-}Y^*{-}C({=}O)$ where n' is from 2 to 6, preferably 3 or 4, and Y* is as defined above; and where at least 2 of the $R^{1*}$, $R^{2*}$, $R^{3*}$ and $R^{4*}$ radicals are hydrogen or halogen.

These include vinyl halides, for example vinyl chloride, vinyl fluoride, vinylidene chloride and vinylidene fluoride;

vinyl esters such as vinyl acetate;

styrene, substituted styrenes having an alkyl substituent in the side chain, for example α-methyl-styrene and α-ethylstyrene, substituted styrenes having an alkyl substituent on the ring, such as vinyltoluene and p-methylstyrene, halogenated styrenes, for example monochlorostyrenes, dichlorostyrenes, tribromostyrenes and tetrabromostyrenes;

heterocyclic vinyl compounds such as 2-vinylpyridine, 3-vinylpyridine, 2-methyl-5-vinylpyridine, 3-ethyl-4-vinylpyridine, 2,3-dimethyl-5-vinylpyridine, vinyl-pyrimidine, vinylpiperidine, 9-vinylcarbazole, 3-vinyl-carbazole, 4-vinylcarbazole, 1-vinylimidazole, 2-methyl-1-vinylimidazole, N-vinylpyrrolidone, 2-vinyl-pyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinyl-thiazoles and hydrogenated vinylthiazoles, vinyl-oxazoles and hydrogenated vinyloxazoles;

vinyl and isoprenyl ethers;

maleic acid and maleic acid derivatives, for example maleic anhydride, methylmaleic anhydride, maleimide, methylmaleimide;

fumaric acid and fumaric acid derivatives;

acrylic acid and (meth)acrylic acid;

dienes, for example divinylbenzene.

The compositions for preparing preferred polyalkyl esters more preferably comprise monomers which can be represented by the formula (III)

(III)

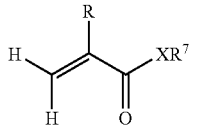

in which R is independently hydrogen or methyl, $R^7$ is independently a group which comprises from 2 to 1000 carbon atoms and has at least one heteroatom, X is independently a sulfur or oxygen atom or a group of the formula $NR^{11}$ in which $R^{11}$ is independently hydrogen or a group having from 1 to 20 carbon atoms, and n is an integer greater than or equal to 3.

The $R^7$ radical is a group comprising from 2 to 1000, in particular from 2 to 100, preferably from 2 to 20 carbon atoms. The term "group having from 2 to 1000 carbon" denotes radicals of organic compounds having from 2 to 1000 carbon atoms. It encompasses aromatic and heteroaromatic groups, and also alkyl, cycloalkyl, alkoxy, cycloalkoxy, alkenyl, alkanoyl, alkoxycarbonyl groups, and also heteroaliphatic groups. The groups mentioned may be branched or unbranched. In addition, these groups may have customary substituents. Substituents are, for example, linear and branched alkyl groups having from 1 to 6 carbon atoms, for example methyl, ethyl, propyl, butyl, pentyl, 2-methylbutyl or hexyl; cycloalkyl groups, for example cyclopentyl and cyclohexyl; aromatic groups such as phenyl or naphthyl; amino groups, ether groups, ester groups and halides.

According to the invention, aromatic groups denote radicals of mono- or polycyclic aromatic compounds having preferably from 6 to 20, in particular from 6 to 12, carbon atoms. Heteroaromatic groups denote aryl radicals in which at least one CH group has been replaced by N and/or at least two adjacent CH groups have been replaced by S, NH or O, heteroaromatic groups having from 3 to 19 carbon atoms.

Aromatic or heteroaromatic groups preferred in accordance with the invention derive from benzene, naphthalene, biphenyl, diphenyl ether, diphenylmethane, diphenyldimethylmethane, bisphenone, diphenylsulfone, thiophene, furan, pyrrole, thiazole, oxazole, imidazole, isothiazole, isoxazole, pyrazole, 1,3,4-oxa-diazole, 2,5-diphenyl-1,3,4-oxadiazole, 1,3,4-thia-diazole, 1,3,4-triazole, 2,5-diphenyl-1,3,4-triazole, 1,2,5-triphenyl-1,3,4-triazole, 1,2,4-oxadiazole, 1,2,4-thiadiazole, 1,2,4-triazole, 1,2,3-triazole, 1,2,3,4-tetrazole, benzo[b]thiophene, benzo[b]furan, indole, benzo[c.] thiophene, benzo[c]furan, isoindole, benzoxazole, benzothiazole, benzimidazole, benz-isoxazole, benzisothiazole, benzopyrazole, benzo-thiadiazole, benzotriazole, dibenzofuran, dibenzo-thiophene, carbazole, pyridine, bipyridine, pyrazine, pyrazole, pyrimidine, pyridazine, 1,3,5-triazine, 1,2,4-triazine, 1,2,4,5-triazine, tetrazine, quinoline, isoquinoline, quinoxaline, quinazoline, cinnoline, 1,8-naphthyridine, 1,5-naphthyridine, 1,6-naphthyri-dine, 1,7-naphthyridine, phthalazine, pyridopyrimidine, purine, pteridine or quinolizine, 4H-quinolizine, diphenyl ether, anthracene, benzopyrrole, benzooxathiadiazole, benzooxadiazole, benzopyridine, benzopyrazine, benzopyrazidine, benzopyrimidine, benzotriazine, indolizine, pyridopyridine, imidazopyrimidine, pyrazinopyrimidine, carbazole, aciridine, phenazine, benzoquinoline, phenoxazine, phenothiazine, acridizine, benzopteridine, phenanthroline and phenanthrene, each of which may also be substituted.

The preferred alkyl groups include the methyl, ethyl, propyl, isopropyl, 1-butyl, 2-butyl, 2-methylpropyl, tert-butyl radical, pentyl, 2-methylbutyl, 1,1-di-methylpropyl, hexyl, heptyl, octyl, 1,1,3,3-tetra-methylbutyl, nonyl, 1-decyl, 2-decyl, undecyl, dodecyl, pentadecyl and the eicosyl group.

The preferred cycloalkyl groups include the cyclo-propyl, cyclobutyl, cyclopentyl, cyclohexyl, cyclo-heptyl and the cyclooctyl group, each of which is optionally substituted with branched or unbranched alkyl groups.

The preferred alkenyl groups include the vinyl, allyl, 2-methyl-2-propenyl, 2-butenyl, 2-pentenyl, 2-decenyl and the 2-eicosenyl group.

The preferred alkynyl groups include the ethynyl, propargyl, 2-methyl-2-propynyl, 2-butynyl, 2-pentynyl and the 2-decynyl group.

The preferred alkanoyl groups include the formyl, acetyl, propionyl, 2-methylpropionyl, butyryl, valeroyl, pivaloyl, hexanoyl, decanoyl and the dodecanoyl group.

The preferred alkoxycarbonyl groups include the methoxycarbonyl, ethoxycarbonyl, propoxycarbonyl, butoxycarbonyl, tert-butoxycarbonyl, hexyloxycarbonyl, 2-methylhexyloxycarbonyl, decyloxycarbonyl or dodecyloxycarbonyl group.

The preferred alkoxy groups include alkoxy groups whose hydrocarbon radical is one of the aforementioned preferred alkyl groups.

The preferred cycloalkoxy groups include cycloalkoxy groups whose hydrocarbon radical is one of the aforementioned preferred cycloalkyl groups.

The preferred heteroatoms which are present in the $R^{10}$ radical include oxygen, nitrogen, sulfur, boron, silicon and phosphorus.

In a particular embodiment of the present invention, the $R^7$ radical in formula (III) has at least one group of the formula —OH or —$NR^8R^8$ in which $R^8$ independently comprises hydrogen or a group having from 1 to 20 carbon atoms.

The X group in formula (III) can preferably be illustrated by the formula NH.

The numerical ratio of heteroatoms to carbon atoms in the $R^7$ radical of the formula (III) may lie within wide ranges. This ratio is preferably in the range from 1:1 to 1:10, in particular from 1:1 to 1:5 and more preferably from 1:2 to 1:4.

The $R^7$ radical of the formula (III) comprises from 2 to 1000 carbon atoms. In a particular aspect, the $R^7$ radical has at most 10 carbon atoms.

The particularly preferred comonomers include aryl(meth) acrylates such as benzyl methacrylate or phenyl methacrylate in which the aryl radicals may each be unsubstituted or up to tetrasubstituted; methacrylates of halogenated alcohols, such as 2,3-dibromopropyl methacrylate, 4-bromophenyl methacrylate, 1,3-dichloro-2-propyl methacrylate, 2-bromoethyl methacrylate, 2-iodoethyl methacrylate, chloromethyl methacrylate; hydroxyalkyl(meth)acrylates such as 3-hydroxypropyl methacrylate, 3,4-dihydroxybutyl methacrylate, 2-hydroxyethyl methacrylate, 2-hydroxypropyl methacrylate, 2,5-dimethyl-1,6-hexanediol (meth)acrylate, 1,10-decanediol (meth)acrylate, carbonyl-containing methacrylates such as 2-carboxyethyl methacrylate, carboxymethyl methacrylate, oxazolidinylethyl methacrylate, N-(methacryloyloxy)formamide, acetonyl methacrylate, N-methacryloylmorpholine, N-methacryloyl-2-pyrrolidinone, N-(2-methacryloyloxyethyl)-2-pyrrolidinone, N-(3-methacryloyloxypropyl)-2-pyrrolidinone, N-(2-methacryloyloxypentadecyl)-2-pyrrolidinone, N-(3-methacryloyloxyheptadecyl)-2-pyrrolidinone; glycol dimethacrylates such as 1,4-butanediol methacrylate, 2-butoxyethyl methacrylate, 2-ethoxy-ethoxymethyl methacrylate, 2-ethoxyethyl methacrylate; methacrylates of ether alcohols, such as tetrahydrofurfuryl methacrylate, vinyloxyethoxyethyl methacrylate, methoxyethoxyethyl methacrylate, 1-butoxypropyl methacrylate, 1-methyl-(2-vinyloxy)ethyl methacrylate, cyclohexyloxymethyl methacrylate, methoxymethoxyethyl methacrylate, benzyloxymethyl methacrylate, furfuryl methacrylate, 2-butoxyethyl methacrylate, 2-ethoxyethoxymethyl methacrylate, 2-ethoxyethyl methacrylate, allyloxymethyl methacrylate, 1-ethoxybutyl methacrylate, methoxymethyl methacrylate, 1-ethoxyethyl methacrylate, ethoxymethyl methacrylate and ethoxylated (meth)-acrylates which have preferably from 1 to 20, in particular from 2 to 8, ethoxy groups; aminoalkyl(meth)acrylates and aminoalkyl(meth)-acrylamides, such as N-(3-dimethylaminopropyl)meth-acrylamide, dimethylaminopropyl methacrylate, 3-diethylaminopentyl methacrylate, 3-dibutylaminohexadecyl(meth)acrylate; nitriles of (meth)acrylic acid and other nitrogen-containing methacrylates, such as N-(methacryloyloxyethyl)diisobutyl ketimine, N-(methacryloyloxyethyl)dihexadecyl ketimine, methacryloylamidoacetonitrile, 2-methacryloyloxyethylmethylcyanamide, cyanomethyl methacrylate; heterocyclic (meth)acrylates such as 2-(1-imidazolyl)-ethyl(meth)acrylate, 2-(4-morpholinyl) ethyl(meth)-acrylate and 1-(2-methacryloyloxyethyl)-2-pyrrolidone; oxiranyl methacrylates such as 2,3-epoxybutyl methacrylate, 3,4-epoxybutyl methacrylate, 10,11-epoxyundecyl methacrylate, 2,3-epoxycyclohexyl methacrylate, 10,11-epoxyhexadecyl methacrylate; glycidyl methacrylate; sulfur-containing methacrylates such as ethylsulfinylethyl methacrylate, 4-thiocyanatobutyl methacrylate, ethylsulfonylethyl methacrylate, thiocyanatomethyl methacrylate, methylsulfinylmethyl methacrylate, bis(methacryloyloxyethyl)sulfide; phosphorus-, boron- and/or silicon-containing meth-acrylates such as 2-(dimethylphosphato)propyl methacrylate, 2-(ethylenephosphito)propyl methacrylate, dimethylphosphinomethyl methacrylate, dimethylphosphonoethyl methacrylate, diethylmethacryloyl phosphonate, dipropylmethacryloyl phosphate, 2-(dibutylphosphono)-ethyl methacrylate, 2,3-butylenemethacryloylethyl borate, methyldiethoxymethacryloylethoxysilane, diethylphosphatoethyl methacrylate.

These monomers may be used individually or as a mixture.

The ethoxylated (meth)acrylates may be obtained, for example, by transesterification of alkyl(meth)-acrylates with ethoxylated alcohols which more preferably have from 1 to 20, in particular from 2 to 8, ethoxy groups. The hydrophobic radical of the ethoxylated alcohols may preferably comprise from 1 to 40, in particular from 4 to 22, carbon atoms, and either linear or branched alcohol radicals may be used. In a further preferred embodiment, the ethoxylated (meth)acrylates have an OH end group.

Examples of commercially available ethoxylates which can be employed for the preparation of ethoxylated (meth) acrylates are ethers of the Lutensol® A brands, in particular Lutensol®A 3 N, Lutensol® A 4 N, Lutensol® A 7 N and Lutensol® A 8 N, ethers of the Lutensol® TO brands, in particular Lutensol® TO 2, Lutensol® TO 3, Lutensol® TO 5, Lutensol® TO 6, Lutensol® TO 65, Lutensol® TO 69, Lutensol® TO 7, Lutensol® TO 79, Lutensol® 8 and Lutensol® 89, ethers of the Lutensol® AO brands, in particular Lutensol® AO 3, Lutensol® AO 4, Lutensol® AO 5, Lutensol® AO 6, Lutensol® AO 7, Lutensol® AO 79, Lutensol® AO 8 and Lutensol® AO 89, ethers of the Lutensol® ON brands, in particular Lutensol® ON 30, Lutensol® ON 50, Lutensol® ON 60, Lutensol® ON 65, Lutensol® ON 66, Lutensol® ON 70, Lutensol® ON 79 and Lutensol® ON 80, ethers of the Lutensol® XL brands, in particular Lutensol® XL 300, Lutensol® XL 400, Lutensol® XL 500, Lutensol® XL 600, Lutensol® XL 700, Lutensol® XL 800, Lutensol® XL 900 and Lutensol® XL 1000, ethers of the Lutensol® AP brands, in particular Lutensol® AP 6, Lutensol® AP 7, Lutensol® AP 8, Lutensol® AP 9, Lutensol® AP 10, Lutensol® AP 14 and Lutensol® AP 20, ethers of the IMBENTIN® brands, in particular of the IMBENTIN® AG brands, of the IMBENTIN® U brands, of the IMBENTIN® C brands, of the IMBENTIN® T brands, of the IMBENTIN® OA brands, of the IMBENTIN® POA brands, of the IMBENTIN® N brands and of the IMBENTIN® O brands and ethers of the Marlipal® brands, in particular Marlipal® 1/7, Marlipal® 1012/6, Marlipal® 1618/1, Marlipal® 24/20, Marlipal® 24/30, Marlipal® 24/40, Marlipal® 013/20, Marlipal® 013/30, Marlipal® 013/40, Marlipal® 025/30, Marlipal® 025/70, Marlipal® 045/30, Marlipal® 045/40, Marlipal® 045/50, Marlipal® 045/70 and Marlipal® 045/80.

Among these, particular preference is given to aminoalkyl (meth)acrylates and aminoalkyl(meth)acryl-amides, for example N-(3-dimethylaminopropyl)-methacrylamide (DMAPMAM), and hydroxyalkyl (meth)acrylates, for example 2-hydroxyethyl methacrylate (HEMA).

Very particularly preferred mixtures for preparing the polyalkyl esters comprise methyl methacrylate, butyl methacrylate, lauryl methacrylate, stearyl methacrylate and/or styrene.

These components may be used individually or as mixtures.

The polyalkyl ester has a specific viscosity $\eta_{sp/c}$, measured at 25° C. in chloroform, in the range from 5 to 30 ml/g, preferably in the range from 10 to 25 ml/g, measured to ISO 1628-6.

The preferred polyalkyl esters which can be obtained by polymerizing unsaturated ester compounds preferably have a polydispersity $M_w/M_n$, in the range from 1.2 to 4.0. This parameter can be determined by gel permeation chromatography (GPC).

The preparation of the polyalkyl esters from the above-described compositions is known per se. For instance, these polymers can be effected especially by free-radical polymerization, and also related processes, for example ATRP (=atom transfer radical polymerization) or RAFT (=reversible addition fragmentation chain transfer).

The customary free-radical polymerization is explained, inter alia, in Ullmanns's Encylopedia of Industrial Chemistry, Sixth Edition. In general, a polymerization initiator and a chain transferrer are used for this purpose.

The usable initiators include the azo initiators well known in the technical field, such as AIBN and 1,1-azo-biscyclohexanecarbonitrile, and also peroxy compounds such as methyl ethyl ketone peroxide, acetylacetone peroxide, dilauryl peroxide, tert-butyl per-2-ethyl-hexanoate, ketone peroxide, tert-butyl peroctoate, methyl isobutyl ketone peroxide, cyclohexanone peroxide, dibenzoyl peroxide, tert-butyl peroxybenzoate, tert-butyl peroxyisopropylcarbonate, 2,5-bis(2-ethylhexanoylperoxy)-2,5-dimethylhexane, tert-butyl peroxy-2-ethylhexanoate, tert-butyl peroxy-3,5,5-trimethylhexanoate, dicumyl peroxide, 1,1-bis-(tert-butylperoxy)cyclohexane, 1,1-bis(tert-butyl-peroxy)-3,3,5-trimethylcyclohexane, cumyl hydro-peroxide, tert-butyl hydroperoxide, bis(4-tert-butyl-cyclohexyl)peroxydicarbonate, mixtures of two or more of the aforementioned compounds with one another, and also mixtures of the aforementioned compounds with compounds which have not been mentioned and can likewise form free radicals. Suitable chain transferrers are especially oil-soluble mercaptans, for example tert-dodecyl mercaptan or 2-mercaptoethanol, or else chain transferrers from the class of the terpenes, for example terpinolene.

The ATRP process is known per se. It is assumed that this is a "living" free-radical polymerization, without any intention that this should restrict the description of the mechanism. In these processes, a transition metal compound is reacted with a compound which has a transferable atom group. This transfers the transferable atom group to the transition metal compound, which oxidizes the metal. This reaction forms a radical which adds onto ethylenic groups. However, the transfer of the atom group to the transition metal compound is reversible, so that the atom group is transferred back to the growing polymer chain, which forms a controlled polymer system. The structure of the polymer, the molecular weight and the molecular weight distribution can be controlled correspondingly.

This reaction is described, for example, by J-S. Wang, et al., J. Am. Chem. Soc., vol. 117, p. 5614-5615 (1995), by Matyjaszewski, Macromolecules, vol. 28, p. 7901-7910 (1995). In addition, the patent applications WO 96/30421, WO 97/47661, WO 97/18247, WO 98/40415 and WO 99/10387, disclose variants of the ATRP explained above.

In addition, the inventive polymers may be obtained, for example, also via RAFT methods. This process is presented in detail, for example, in WO 98/01478, to which reference is made explicitly for the purposes of disclosure.

The polymerization may be carried out at standard pressure, reduced pressure or elevated pressure. The polymerization temperature too is uncritical. However, it is generally in the range of −20°-200° C., preferably 0°-130° C. and more preferably 60°-120° C.

The polymerization may be carried out with or without solvent. The term solvent is to be understood here in a broad sense.

The polymerization is preferably carried out in a nonpolar solvent. These include hydrocarbon solvents, for example aromatic solvents such as toluene, benzene and xylene, saturated hydrocarbons, for example cyclohexane, heptane, octane, nonane, decane, dodecane, which may also be present in branched form. These solvents may be used individually and as a mixture. Particularly preferred solvents are mineral oils, natural oils and synthetic oils, and also mixtures thereof. Among these, very particular preference is given to mineral oils.

In addition, the polyalkyl ester is used in a lubricant oil composition. A lubricant oil composition comprises at least one lubricant oil.

The lubricant oils include especially mineral oils, synthetic oils and natural oils.

Mineral oils are known per se and commercially available. They are generally obtained from mineral oil or crude oil, by distillation and/or refining and optionally further purification and finishing processes, the term mineral oil including in particular the higher-boiling fractions of crude or mineral oil. In general, the boiling point of mineral oil is higher than 200° C., preferably higher than 300° C., at 50 mbar. The production by low-temperature carbonization of shale oil, coking of bituminous coal, distillation of brown coal with exclusion of air, and also hydrogenation of bituminous or brown coal is likewise possible. Mineral oils are also produced in a smaller proportion from raw materials of vegetable (for example from jojoba, rapeseed) or animal (for example neatsfoot oil) origin.

Accordingly, mineral oils have, depending on their origin, different proportions of aromatic, cyclic, branched and linear hydrocarbons.

In general, a distinction is drawn between paraffin-base, naphthenic and aromatic fractions in crude oils or mineral oils, in which the term paraffin-base fraction represents longer-chain or highly branched isoalkanes, and naphthenic fraction represents cyclo-alkanes. In addition, mineral oils, depending on their origin and finishing, have different fractions of n-alkanes, isoalkanes having a low degree of branching, known as mono-methyl-branched paraffins, and compounds having heteroatoms, in particular O, N and/or S, to which a degree of polar properties are attributed. However, the assignment is difficult, since individual alkane molecules may have both long-chain branched groups and cycloalkane radicals, and aromatic parts. For the purposes of the present invention, the assignment can be effected to DIN 51 378, for example. Polar fractions can also be determined to ASTM D 2007.

The fraction of n-alkanes in preferred mineral oils is less than 3% by weight, the proportion of O—, N— and/or S-containing compounds less than 6% by weight. The proportion of the aromatics and of the mono-methyl-branched paraffins is generally in each case in the range from 0 to 40% by weight. In one interesting aspect, mineral oil comprises mainly naphthenic and paraffin-base alkanes which have generally more than 13, preferably more than 18 and most preferably more than 20 carbon atoms. The fraction of these compounds is generally ≥60% by weight, preferably ≥80% by weight, without any intention that this should impose a restriction. A preferred mineral oil contains from 0.5 to 30% by weight of aromatic fractions, from 15 to 40% by weight of naphthenic fractions, from 35 to 80% by weight of paraffin-base fractions, up to 3% by weight of n-alkanes and from 0.05 to 5% by weight of polar compounds, based in each case on the total weight of the mineral oil.

An analysis of particularly preferred mineral oils, which was effected by means of conventional processes such as urea separation and liquid chromatography on silica gel shows, for example, the following constituents, the percentages relating to the total weight of the particular mineral oil used:

n-alkanes having from approx. 18 to 31 carbon atoms:
0.7-1.0%,
slightly branched alkanes having from 18 to 31 carbon atoms:
1.0-8.0%,
aromatics having from 14 to 32 carbon atoms:
0.4-10.7%,
iso- and cycloalkanes having from 20 to 32 carbon atoms:
60.7-82.4%,
polar compounds:
0.1-0.8%,
loss:
6.9-19.4%.

Valuable information with regard to the analysis of mineral oils and a list of mineral oils which have a different composition can be found, for example, in Ullmann's Encyclopedia of Industrial Chemistry, 5th Edition on CD-ROM, 1997, under "lubricants and related products".

Synthetic oils include organic esters, for example diesters and polyesters, polyalkylene glycols, polyethers, synthetic hydrocarbons, especially polyolefins, among which preference is given to polyalphaolefins (PAO), silicone oils and perfluoro-alkyl ethers. They are usually somewhat more expensive than the mineral oils, but have advantages with regard to their performance.

Natural oils are animal or vegetable oils, for example neatsfoot oils or jojoba oils.

These lubricant oils may also be used as mixtures and are in many cases commercially available.

The concentration of the polyalkyl ester in the lubricant oil composition is preferably in the range from 2 to 40% by weight, more preferably in the range from 4 to 20% by weight, based on the total weight of the composition.

In addition to the aforementioned components, a lubricant oil composition may comprise further additives.

These additives include antioxidants, corrosion inhibitors, antifoams, antiwear components, dyes, dye stabilizers, detergents, pour point depressants and/or DI additives. The lubricant oil composition which comprises at least one polyalkyl ester is preferably used as a hydraulic fluid.

The lubricant oil composition may more preferably be used in a vane pump, a gear pump, radial piston pump or an axial piston pump.

The lubricant oil composition may be used preferably at a pressure of from 50 to 450 bar, in particular in a pressure range of 100-350 bar and more preferably in a pressure range of 120-200 bar.

The present invention further relates to novel lubricant oil compositions comprising at least one polyalkyl ester which can be obtained by polymerization of monomer compositions, which consists of a) from 0 to 50% by weight, preferably from 2 to 40% by weight and more preferably from 10 to 30% by weight, based on the weight of the monomer compositions for preparing the polyalkyl esters, of one or more ethylenically unsaturated ester compounds of the formula (I)

(I)

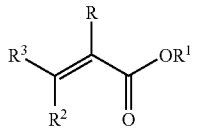

in which R is hydrogen or methyl, $R^1$ is hydrogen, a linear or branched alkyl radical having from 1 to 5 carbon atoms, $R^2$ and $R^3$ are each independently hydrogen or a group of the formula —COOR' in which R' is hydrogen or an alkyl group having from 1 to 5 carbon atoms, b) from 50 to 100% by weight, preferably from 60 to 98% by weight and more preferably from 70 to 90% by weight, based on the weight of the monomer compositions for preparing the polyalkyl esters, of one or more ethylenically unsaturated ester compounds of the formula (II)

(II)

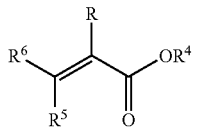

in which R is hydrogen or methyl, $R^4$ is a linear or branched alkyl radical having from 6 to 30 carbon atoms, $R^5$ and $R^6$ are each independently hydrogen or a group of the formula —COOR" in which R" is hydrogen or an alkyl group having from 6 to 30 carbon atoms, c) from 0 to 50% by weight, preferably from 2 to 40% by weight and more preferably from 5 to 30% by weight, based on the weight of the monomer compositions for preparing the polyalkyl esters, of comonomers, the polyalkyl ester having a specific viscosity $\eta_{sp/c}$, measured at 25° C. in chloroform, of between 5 and 30 ml/g, but in particular, of 10-25 ml/g, wherein the lubricant oil composition, by virtue of addition of polyalkyl esters, has a hydraulic performance $P_a$ at a temperature $T_1$+x, where $T_1$ is greater than or equal to 20° C., $T_1$ preferably being in the range from 50 to 120° C., and x is greater than or equal to 5° C., x preferably being in the range 10 to 90° C., which is at least as high as the hydraulic line $P_b$ of the hydraulic fluid without addition of polyalkyl esters at the temperature $T_1$, the temperature-dependent performance decline $d(P_a)/dT$ of the lubricant oil composition comprising polyalkyl esters being smaller than the temperature-dependent performance decline $d(P_b)/dT$ of the lubricant oil composition without polyalkyl esters.

The use of the polyalkyl esters, especially of the novel compounds, leads to an improvement in the hydraulic performance at elevated temperature, which is at least 60° C., preferably at least 80° C. and most preferably at least 90° C.

The polyalkyl ester preferably delays undesired over-heating of the lubricant oil composition at a high hydraulic performance. The high hydraulic performance is preferably at least 60%, in particular at least 70% and more preferably at least 80%, based on the short-term maximum performance.

Preferred lubricant oil compositions have a viscosity, measured at 40° c. to ASTM D 445, in the range from 10 to 120 $mm^2/s$, more preferably in the range from 22 to 100 $mm^2/s$.

In a particular aspect of the present invention, preferred lubricant oil compositions have a viscosity index, determined to ASTM D 2270, in the range from 120 to 350, in particular from 140 to 200.

The invention will be illustrated in more detail below by examples and comparative examples without any intention that the invention should be restricted to these examples.

A) Test Methods

To determine the influence of the hydraulic fluid on the performance/temperature behavior of hydraulic systems, a performance test bench for hydraulic pumps was selected in order to rule out weather-related variations in the operating conditions. The following design parameters for design of the performance test bench were laid down:

- Construction in a closed test bench cell space with temperature- and throughput-controlled regulatable air input and output
- Driving of the hydraulic pump with speed-controlled electric motor, power 22 kW, measuring unit for speed and drive torque
- Hydraulic system with vane pump, pressure range up to 270 bar
- Thermally insulated reservoir vessel for the hydraulic fluid (HF)
- Automated operation for various operating modes
- Automated test data capture, possibility of static evaluation of the test data The performance test bench construction is described in FIG. 1; the meaning of the numbers and components used therein can be taken from the first two columns of the table which follows.

| No. | Designation | Model | Technical data | |
|---|---|---|---|---|
| 1 | Hydraulic pump | Denison T6C-06 | Displacement | 21.3 $cm^3$/rotation |
| | | | Pressure | 320 bar max. operating pressure |
| | | | Speed | 750 and 1500 1/min |
| 2 | Drive motor | EMK | Voltage | 400 V |
| | | | Power | 22 kW |
| | | | Speed | 1500 1/min |
| 3 | Flush motor | Elektra | Voltage | 400 V |
| | | | Power | 0.75 kW |
| | | | Speed | 1400 1/min |
| 4 | Flush pump | hp-Technik | Volume flow rate | 100 l/h |
| | | | Pressure | 9 bar max. |
| 5 | Tank, thermally insulated, with sensor for fill level and temperature | | Fill volume | 90 kg |
| 6 | Main line system | | Pipe diameter | 1¼" |
| 7 | Flow meter | | Measurement range | 7.5-75 1/min |
| 8 | Proportional valve | Rexroth | | |
| 9 | Filter | Pall | 420 bar max. | |
| 10 | Heat exchanger | Funke A050 | Capacity | 0.69 l |
| | | | Operating pressure | 30 bar |
| | | | Max. temp. | 200° C. |
| 11 | Heat exchanger | Funke A060 | Capacity | 1.08 l |
| | | | Operating pressure | 30 bar |
| | | | Max. temp. | 200° C. |
| 12 | Heat exchanger | Funke A090 | Capacity | 0.62 l |
| | | | Operating pressure | 30 bar |
| | | | Max. temp. | 200° C. |

A suction line with heat exchanger for heating and cooling for hydraulic fluid was used. Both high-pressure fine filters and low-pressure fine filters were utilized, and also an electrically actuated pressure regulation valve up to 270 bar.

For the purpose of reproducibility of the results generated, a strictly defined test program was followed.

After the test bench had been started up, the new vane pump was first run in for one day with changing speeds and loads. To this end, a commercial hydraulic fluid of the ISO 46 or ISO 68 class was used. Afterward, all test fluids were subjected to the following test program:

1. Conditioning of the test bench cell and all plant parts to 20° C. (overnight).
2. Installation of cleaned high- and low-pressure fine filters (first set of filters).
3. Flushing: filling of the reservoir vessel with 55 kg of test fluid.
   Subsequent operation at: pump speed 750 l/min, pressure 50 bar, fluid suction temperature 80° C., 2 h.
4. Discharge of the test fluid, deinstallation of the high- and low-pressure filters.
5. Installation of cleaned high- and low-pressure fine filters (second set of filters), filling of the reservoir vessel with 80 kg of test fluid.
6. Heating test: pump speed 1500 l/min, pressure 150 bar, cooling and heating switched off, ambient temperature 20° C., liquid suction temperature approx. 40° C. at start, approx. 90° C. at end.

7. Efficiency test: pump speed 1500 l/min, pressure 50 bar at start, 250 bar at end, in 50 bar stages, fluid suction temperature constant at 80° C.
8. Cooling cycle: pump speed 750 l/min, pressure 0 bar, liquid suction temperature approx. 90° C. at start, approx. 40° C. at end.
9. Heating test: pump speed 1500 l/min, pressure 250 bar, cooling and heating switched off, ambient temperature 20° C., liquid suction temperature approx. 40° C. at start, approx. 90° C. at end.
10. Efficiency test: pump speed of 1500 l/min, pressure 50 bar at start, 250 bar at end, in 50 bar stages, liquid suction temperature constant at 80° C.
11. Discharge of the test fluid, deinstallation of the high- and low-pressure filter.

The data underlying the present invention were measured in steps 6 and 9 of the above-described test program. They were each test phases which proceeded with the cooling switched off. It was thus possible to determine the temperature increase in the pump. A smaller temperature increase which is possessed by a hydraulic fluid with an additive is therefore to be equated to a reduction in the temperature compared to a hydraulic fluid without additive. Step 6 was carried out at a pressure of 150 bar, step 9 at a pressure of 250 bar.

The hydraulic performance can be derived directly via the current flow rate of a hydraulic pump. In general: the higher the current flow rate Qa and the associated volume flow rate in a hydraulic plant, the higher the hydraulic performance. In the above-described hydraulic circulation system with the flow meter device mentioned, the current flow rate could be read off directly. The hydraulic performance could be determined directly via the relationship described in the literature (see, for example, F.-W. Höfer et al., Memento de Technologie Automobile, 1ere Edition, p. 650, Robert Bosch GmbH, 1988):

$$PH(\text{in kW})=(P\text{out}*Qa)/600$$

where Pout=pressure at pump outlet in bar and Qa current flow rate in l/min.

The tests consist in determining the current flow rates as a function of the measured fluid temperatures at a pressure of 150 and 250 bar (pump outlet). The relationship abovementioned allows the hydraulic performance to be concluded directly at a certain liquid temperature.

B) Preparation of Polyalkyl Esters

The polymer solutions A-D were each synthesized in a mineral oil by means of customary free-radical polymerization, as explained, inter alia, in Ullmanns's Encylopedia of Industrial Chemistry, Sixth Edition. The polymerization initiator used was tert-butyl peroctoate and the chain transferrer was decyl mercaptan. The mineral oil used as the solvent was a 100 solvent neutral oil from Kuwait Petroleum. Polymerization was effected at a temperature of 100° C. and replenished with tert-butyl peroctoate, and continued thereafter until the residual monomer contents of the polymer solutions prepared were less than 2% by weight. This was generally the case after a total process time of 6 h. Polymers A-D contained between 11 and 27% by weight of methyl methacrylate and between 63 and 89% by weight of a mixture of long-chain alkyl-substituted $C_{12-18}$ methacrylates, based in each case on the total weight of the monomers used. The specific viscosity $\eta_{sp/c}$, measured at 25° C. in chloroform, was 17 ml/g for polymer A, 21 ml/g for polymer B, 25 ml/g for polymer C and 40 ml/g in the case of polymer D.

a) Preparation of Polymer A

| Monomer mixture composition: | |
|---|---|
| 54.375 kg | of C12-18-alkyl methacrylate mixture |
| 18.125 kg | of methyl methacrylate |
| Initial charge: | |
| 27.5 kg | of 100N mineral oil |
| 4.1 kg | of monomer mixture |
| 0.01 kg | of dodecyl mercaptan |
| 0.026 kg | of tert-butyl per-2-ethylhexanoate |
| Feed: | |
| 68.4 kg | of monomer mixture |
| 0.20 kg | of tert-butyl per-2-ethylhexanoate |
| 0.86 kg | of dodecyl mercaptan |
| Replenishment step: | |
| 0.126 kg | of tert-butyl per-2-ethylhexanoate |

Process Description:

A 150 l polymerization reactor equipped with reflux condenser and stirrer is charged at room temperature with the components listed above (initial charge). Subsequently, the initial charge is degassed with 0.62 kg of dry ice and heated to a temperature of 100° C. After 5 minutes, the amount of initiator calculated for the initial charge is added and the feed is simultaneously started. The entire amount of feed is metered into the reactor within 3.5 hours. Afterward, the mixture is stirred at 100° C. for a further 2 hours. Subsequently, the product is replenished with initiator and stirred at 100° C. for a further 2 hours.

$\eta_{sp/c}$=17 ml/g b) Preparation of Polymer B

| Monomer mixture composition: | |
|---|---|
| 62.35 kg | of C12-18-alkyl methacrylate mixture |
| 10.15 kg | of methyl methacrylate |
| Initial charge: | |
| 27.5 kg | of 100N mineral oil |
| 4.1 kg | of monomer mixture |
| 0.01 kg | of dodecyl mercaptan |
| 0.026 kg | of tert-butyl per-2-ethylhexanoate |
| Feed: | |
| 68.4 kg | of monomer mixture |
| 0.19 kg | of tert-butyl per-2-ethylhexanoate |
| 0.53 kg | of dodecyl mercaptan |
| Replenishment step: | |
| 0.126 kg | of tert-butyl per-2-ethylhexanoate |

Process Description:

The preparation is effected as described for polymer A).

$\eta_{sp/c}$=21 ml/g c) Preparation of Polymer C

| Monomer mixture composition: | |
|---|---|
| 60.9 kg | of C12-18-alkyl methacrylate mixture |
| 9.1 kg | of methyl methacrylate |

-continued

| | |
|---|---|
| Initial charge: | |
| 30.0 kg | of 100N mineral oil |
| 4.1 kg | of monomer mixture |
| 0.01 kg | of dodecyl mercaptan |
| 0.026 kg | of tert-butyl per-2-ethylhexanoate |
| Feed: | |
| 65.9 kg | of monomer mixture |
| 0.22 kg | of tert-butyl per-2-ethylhexanoate |
| 0.27 kg | of dodecyl mercaptan |
| Replenishment step: | |
| 0.126 kg | of tert-butyl per-2-ethylhexanoate |

Process description:

The preparation is effected as described for polymer A).

$\eta_{sp/c}$=25 ml/g d) Preparation of Polymer D

| | |
|---|---|
| Monomer mixture composition: | |
| 54.8 kg | of C12-18-alkyl methacrylate mixture |
| 8.2 kg | of methyl methacrylate |
| Initial charge: | |
| 37.0 kg | of 100N mineral oil |
| 4.1 kg | of monomer mixture |
| 0.01 kg | of dodecyl mercaptan |
| 0.026 kg | of tert-butyl per-2-ethylhexanoate |
| Feed: | |
| 58.9 kg | of monomer mixture |
| 0.15 kg | of tert-butyl per-2-ethylhexanoate |
| 0.12 kg | of dodecyl mercaptan |
| Replenishment step: | |
| 0.126 kg | of tert-butyl per-2-ethylhexanoate |

Process description:

The preparation is effected as described for polymer A).

$\eta_{sp/c}$=40 ml/g

C) Working Examples 1 to 7 and Comparative Examples 1 to 4

Various hydraulic oils were prepared from the polymers. The composition of the hydraulic oils is reproduced in table 1. The formulations were prepared according to DIN 51524. The kinematic viscosities of the ISO grade 46 oils were accordingly within a viscosity range of 46 $mm^2/s$±10%, and the viscosities of the ISO 68 grade oils within a range of 68 $mm^2/s$±10%.

To prepare the formulations, polymers predissolved in mineral oil (referred to in Tab. 1 as polymer solutions) were used. The polymer concentrations of the polymer solutions used were 72.5% by weight in the case of polymers A and B, 70% by weight in the case of polymer C and 63% by weight in the case of polymer D.

The DI package used for all formulations shown in tab. 1 was the commercial product Oloa 4992 from Oronite. The concentration of Oloa 4992 was kept constant at 0.6% by weight for all formulations examined.

The oils used were all mineral oils whose viscosity index varies within a narrow range around approx. 100 (±5). The mineral oils used may be obtained commercially. For instance, Esso 80 represents an SN 80 oil from ExxonMobil, KPE100 an SN 100 oil from Kuwait Petroleum and Esso 600 an SN 600 oil from ExxonMobil. Unlike the oils mentioned above, Nexbase 3020 is a hydrotreated oil from Fortum.

TABLE 1

| | Polymer solution | Polymer solution [% by wt.] | Esso 80 [% by wt.] | KPE 100 [% by wt.] | Esso 600 [% by wt.] | Nexbase 3020 [% by wt.] |
|---|---|---|---|---|---|---|
| Comp. 1 | — | — | | 50.4 | 49.00 | |
| Ex. 1 | Pol. A | 8.40 | | 65.5 | 25.50 | |
| Ex. 2 | Pol. B | 6.90 | | 66.6 | 25.90 | |
| Ex. 3 | Pol. C | 4.90 | | 65.4 | 29.10 | |
| Comp. 2 | Pol. D | 3.50 | | 65.7 | 30.20 | |
| Ex. 4 | Pol. A | 19.60 | 53 | 26.8 | | |
| Ex. 5 | Pol. B | 14.60 | 19.9 | 64.9 | | |
| Ex. 6 | Pol. C | 11.00 | 7.9 | 80.5 | | |
| Comp. 3 | Pol. D | 8.20 | | 87.1 | 4.10 | |
| Comp. 4 | — | — | | 26 | 73.40 | |
| Ex. 7 | Pol. A | 11.80 | | 47.7 | 39.90 | |
| Ex. 8 | Pol. A | 27.00 | 67.4 | | | 5.0 |

| | % by wt. of Oloa 4992 | Kinematic viscosity at 40° C. [cSt] | Viscosity index (VI) |
|---|---|---|---|
| Comp. 1 | 0.6 | 42.65 | 105 |
| Ex. 1 | 0.6 | 43.34 | 151 |
| Ex. 2 | 0.6 | 44.92 | 153 |
| Ex. 3 | 0.6 | 45.49 | 153 |
| Comp. 2 | 0.6 | 44.07 | 153 |
| Ex. 4 | 0.6 | 47.29 | 194 |
| Ex. 5 | 0.6 | 46.18 | 198 |
| Ex. 6 | 0.6 | 45.36 | 205 |
| Comp. 3 | 0.6 | 45.29 | 212 |
| Comp. 4 | 0.6 | 67.47 | 103 |
| Ex. 7 | 0.6 | 66.23 | 152 |
| Ex. 8 | 0.6 | 70.96 | 191 |

The selection of the oil or of the oil mixtures in the preparation of the formulations (in the above exemplary and comparative formulations, the weight ratio between Esso 80, KPE 100, Esso 600 and Nexbase 3020) does not play any role in this context, provided that oils are used within a narrowly defined VI range and all formulations are adjusted to identical kinematic viscosities. The selection of different oil compositions, as shown in table 1, was based merely on keeping the kinematic viscosities measured at 40° C. at constant values of 46 $mm^2/s$ (±10%) for ISO 46 fluids and of 68 $mm^2/s$ (±10%) for ISO 68 fluids. This was necessary, since formulations with different polymer concentrations and polymers of different molecular weights were used.

The hydraulic performances measured at different temperatures can be taken from tables 2 and 3 which follow.

TABLE 2

Hydraulic power, measured at different temperatures, of the different hydraulic fluids at a pressure of 150 bar

| Temperature (suction nozzle) [° C.] | Comparative example 1 [kW] | Example 1 [kW] | Example 2 [kW] |
|---|---|---|---|
| 55 | 6.889 | 6.941 | 6.995 |
| 65 | 6.549 | 6.646 | 6.721 |
| 75 | 6.179 | 6.321 | 6.409 |
| 85 | 5.750 | 6.129 | 6.075 |

TABLE 2-continued

Hydraulic power, measured at different temperatures, of the different hydraulic fluids at a pressure of 150 bar

| Temperature (suction nozzle) [° C.] | Example 3 [kW] | Comparative example 2 [kW] | Example 4 [kW] |
|---|---|---|---|
| 55 | 6.925 | 6.972 | 7.045 |
| 65 | 6.596 | 6.538 | 6.811 |
| 75 | 6.296 | 6.178 | 6.559 |
| 85 | 5.900 | 5.804 | 6.258 |

| Temperature (suction nozzle) [° C.] | Example 5 [kW] | Example 6 [kW] | Comparative example 3 [kW] |
|---|---|---|---|
| 55 | 7.000 | 6.934 | 6.770 |
| 65 | 6.738 | 6.679 | 6.462 |
| 75 | 6.459 | 6.350 | 6.133 |
| 85 | 6.121 | 6.004 | 5.775 |

TABLE 3

Hydraulic performance, measured at different temperatures, of the different hydraulic fluids at a pressure of 250 bar

| Temperature (suction nozzle) [° C.] | Comparative example 1 [kW] | Example 1 [kW] | Example 2 [kW] |
|---|---|---|---|
| 55 | 9.754 | 9.913 | 10.042 |
| 65 | 8.833 | 9.024 | 9.322 |
| 75 | 7.807 | 8.167 | 8.452 |
| 85 | 6.500 | 7.302 | 7.555 |

| Temperature (suction nozzle) [° C.] | Example 3 [kW] | Comparative example 2 [kW] | Example 4 [kW] |
|---|---|---|---|
| 55 | 9.766 | 9.583 | 10.242 |
| 65 | 8.864 | 8.708 | 9.613 |
| 75 | 7.920 | 7.664 | 8.833 |
| 85 | 6.864 | 6.505 | 8.122 |

| Temperature (suction nozzle) [° C.] | Example 5 [kW] | Example 6 [kW] |
|---|---|---|
| 55 | 10.042 | 9.800 |
| 65 | 9.337 | 9.042 |
| 75 | 8.500 | 8.247 |
| 85 | 7.670 | 7.342 |

| Temperature (suction nozzle) [° C.] | Comparative example 4 [kW] | Example 7 [kW] | Example 8 [kW] |
|---|---|---|---|
| 55 | 10.750 | 10.825 | 10.904 |
| 65 | 10.083 | 10.242 | 10.421 |
| 75 | 9.170 | 9.500 | 9.837 |
| 85 | 8.122 | 8.705 | 9.163 |

In all experiments which were carried out with fluids of class ISO 46 at a pressure of 150 bar, it was found that better performance/temperature ratios were achieved in comparison to a polymer-free liquid (comp. 1) when the formulations comprising polymer solution A, B or C according to examples 1 to 6 were used. This became especially clear at high fluid temperatures (above, for example, 60° C.). The data which can be found in the appendix likewise show that this was achievable irrespective of whether relatively low (4.9-8.4% by weight in the case of example studies 1, 2 and 3) or relatively high (11.0-19.6% by weight in the case of example studies 4, 5 and 6) concentrations of the particular polymer solution A, B or C were used. When, however, polymer solution D was used, which was characterized in that it had a higher molecular weight of the polymer in comparison to solution A, B or C, poorer performance/temperature ratios were observed in the direct comparison with the polymer-free formulation.

When identical experiments with ISO 46 fluids were carried out at a pressure of 250 bar instead of 150 bar, the improvement by virtue of the formulation according to example 3, which contained 4.9% by weight of polymer solution C, decreased compared to the polymer-free oil. The formulation comprising the polymer D according to comparative example 2, in contrast, was distinctly inferior to the polymer-free oil according to comparative example 1, which was also the case at 150 bar. The oils containing polymer solution A and B according to examples 1 and 2 were distinctly superior at a pressure of 250 bar to the polymer-free oil according to comparative example 1.

This effect is not restricted to the kinematic viscosity. Thus, examples 7 and 8 in comparison with comparative example 4 show that an unexpected performance rise can be achieved even with ISO 68 fluids (see comparative example 4 and examples 7 and 8 in tab. 3). This could be demonstrated both at 150 bar and at 250 bar.

What is claimed is:

1. A method of reducing the temperature in a lubricant oil composition, comprising:

adding 4.9 to 27 wt % of at least one polyalkyl ester having a specific viscosity $\eta_{sp/c}$, measured at 25° C. in chloroform, of between 17 and 25 ml/g, to a lubricant oil composition, wherein said lubricant oil composition is a class ISO 46 or ISO 68 fluid;

wherein the at least one polyalkyl ester is prepared by polymerization of a monomer composition which consists of a) from 13 to 25% by weight of methylmethacrylate, based on the weight of the monomer composition, and b) from 75 to 87% by weight of a $C_{12}$-$C_{18}$ alkyl methacrylate, based on the weight of the monomer composition, wherein the lubricant oil composition, by virtue of addition of said at least one polyalkyl ester, has a hydraulic performance $P_a$ at a temperature $T_1$+x, where $T_1$ is greater than or equal to 20° C. and x is greater than or equal to 5° C., which is at least as high as the performance of the hydraulic line $P_b$ of the hydraulic fluid without addition of polyalkyl ester at the temperature $T_1$, wherein said hydraulic performance $P_a$ is measured at temperatures of between 65 and 85° C.

2. A lubricant oil composition, comprising:

4.9 to 27 wt % of at least one polyalkyl ester prepared by polymerization of a monomer composition which consists of:

a) from 13 to 25% by weight of methylmethacrylate, based on the weight of the monomer composition, b) from 75 to 87% by weight of a $C_{12}$-$C_{18}$ alkyl methacrylate, based on the weight of the monomer, the polyalkyl ester having a specific viscosity $\eta_{sp/c}$, measured at 25° C. in chloroform, of between 17 and 25 ml/g, wherein said lubricant oil composition is a class ISO 46 or ISO 68 fluid;

wherein the lubricant oil composition, by virtue of addition of said at least one polyalkyl ester, has a hydraulic performance $P_a$ at a temperature $T_1$+x, where $T_1$ is greater than or equal to 20° C. and x is greater than or equal to 5°

C., which is at least as high as the performance of the hydraulic line $P_b$ of the hydraulic fluid without addition of polyalkyl ester at the temperature $T_1$, wherein said hydraulic performance $P_a$ is measured at temperatures of between 65 and 85° C., the temperature-dependent performance decline $d(P_a)/dT$ of the lubricant oil composition comprising said at least one polyalkyl ester being smaller than the temperature-dependent performance decline $d(P_b)/dT$ of the lubricant oil composition without polyalkyl ester.

3. The method of claim 1, wherein the polyalkyl ester leads to an improvement in the hydraulic performance at elevated temperature.

4. The method of claim 3, wherein the temperature is at least 60° C.

5. The method of claim 1, wherein the polyalkyl ester delays overheating of the lubricant oil composition during elevated hydraulic performance.

6. The method of claim 1, wherein the lubricant oil composition is a hydraulic fluid.

7. The method of claim 1, wherein the lubricant oil composition has a kinematic viscosity, measured at 40° C., in the range from 10 to 120 $mm^2/s$.

8. The method of claim 1, wherein the lubricant oil composition has a viscosity index in the range from 120 to 350.

9. The method of claim 1, wherein the lubricant oil composition comprises from 2 to 40% by weight of polyalkyl esters.

10. The method of claim 1, wherein the lubricant oil composition comprises one or more additives selected from the group consisting of antioxidants, corrosion inhibitors, antifoams, antiwear components, dyes, dye stabilizers, detergents, pour point depressants and DI additives.

11. The method of claim 1, wherein the lubricant oil composition is used in a vane pump, a gear pump, radial piston pump or an axial piston pump.

12. The method of claim 1, wherein the lubricant oil composition is used at a pressure of from 150 to 320 bar.

13. The lubricant oil composition of claim 2, wherein $T_1$ is in the range from 50 to 120° C.

14. The lubricant oil composition of claim 2, wherein x is in the range from 10 to 90° C.

15. The lubricant oil composition of claim 2, wherein the polyalkyl ester has a polydispersity $M_w/M_n$ in the range from 1.2 to 4.0.

16. The lubricant oil composition of claim 2, which is a hydraulic fluid.

* * * * *